United States Patent [19]

Jewell et al.

[11] Patent Number: 4,760,854

[45] Date of Patent: Aug. 2, 1988

[54] TOBACCO EXPANSION PROCESS

[75] Inventors: John N. Jewell; Kevin R. Korte, both of Louisville, Ky.

[73] Assignee: Brown & Williamson Tobacco Corporation, Louisville, Ky.

[21] Appl. No.: 803,450

[22] Filed: Dec. 2, 1985

[51] Int. Cl.[4] ..... A24B 3/18

[52] U.S. Cl. ..... 131/291; 131/296; 131/900

[58] Field of Search ..... 131/296, 291, 900

[56] References Cited

U.S. PATENT DOCUMENTS 4,235,250 11/1980 Utsch ..... 131/900

4,336,814 6/1982 Sykes et al. ..... 131/900

*Primary Examiner*—V. Millin

*Attorney, Agent, or Firm*—Charles G. Lamb

[57] ABSTRACT

An improved tobacco treating expansion process involving controlling the moisture content of tobacco and the pre-separator residence time thereof in a treatment of the moisture controlled tobacco under preselected pressures and temperatures so that the tobacco at exit from the drying step of the process has a moisture content in the range of approximately 9% to approximately 15% oven volatiles by weight and fill values at least equivalent to fill values of tobaccos dried to a lower moisture content not exceeding 6% oven volatiles.

13 Claims, No Drawings

TOBACCO EXPANSION PROCESS

CROSS REFERENCE TO RELATED APPLICATIONS

This is a continuation-in-part of application Ser. No. 634,926; filed July 26, 1984 now abandoned.

BACKGROUND OF THE INVENTION

The present invention relates to an improved tobacco treating process and more particularly to an improved process for expanding tobacco wherein the tobacco is maintained at a relatively high moisture content.

A number of processes are known in the art wherein tobacco is expanded by firstly impregnating the tobacco with an expanding agent which may be a gas, such as carbon dioxide under pressure. The impregnated tobacco is then subjected to further treating, usually heat, whereby the expanding agent and the moisture in the tobacco are driven off and the resulting tobacco product is left in an expanded condition. For example, U.S. Pat. No. 4,336,814, issued to Larry M. Sykes et al on June 29, 1982, and No. 4,340,073, issued to Roger Z. de la Burde et al on July 20, 1982, as well as a number of the earlier patents and publications noted therein, teach or suggest such broad process. In addition, a number of patents and patent applications are known in the art which teach structural arrangements for carrying out the process of expanding impregnated tobaccos in duct systems and associated drying chambers such as U.S. Pat. No. 3,357,436, issued on Dec. 12, 1967 to A. H. Wright; U.S. Pat. No. 3,786,573, issued on Jan. 22, 1974 to John J. Scheppe and Raymod N. Carini; U.S. Pat. No. 4,366,825, issued on Jan. 4, 1983 to Frank V. Utsch et al; as well as a number of the earlier patents noted therein. Further, U.S. Pat. No. 4,494,556, issued on 22 Jan. 1985 and U.S. Pat. No. 4,528,995, issued on 16 July 1985, each disclose structural arrangements that can be used for expanding impregnated tobaccos in duct systems and communicating drying chambers, each further teaching a tobacco feed device located substantially at the entrance of a separator device for introducing tobacco to be dried and expanded into the duct at the entrance to the separator device.

The present invention recognizing certain deficiencies in past processes for expanding tobacco, provides an improved process for expanding tobacco with decreased tobacco filling power loss and concommitant decreases in losses of glycerine, alkaloids and sugar. In addition, the process of the present invention provides a decrease in exit dryer tobacco temperature while achieving high particle expansion and increased exit dryer tobacco moisture with resulting larger and less friable particles. With the increased exit dryer tobacco moisture as a result of the present invention little, if any, reordering is required to bring the expanded tobacco product to the final desired moisture content and less cooling and accordingly, less energy is required to bring the exit tobacco product to an acceptable storage temperature. Further, since little or no tobacco reordering is required to bring the expanded product to final desired moisture, little or no water is required to be added and, as a consequence, filling power loss is much decreased.

Various other features of the present invention will become obvious to one skilled in the art upon reading the disclosure set forth herein.

SUMMARY OF THE INVENTION

More particularly the present invention provides an improved tobacco treating process comprising ordering tobacco to a preselected moisture content sufficient to yield an exit tobacco moisture in the range of approximately 9% to approximately 15% oven volatiles and fill values at least equivalent to fill values of tobaccos dried to a moisture content not exceeding 6% oven volatiles, contacting the ordered tobacco under pressure with gaseous carbon dioxide; contacting the ordered tobacco with liquid carbon dioxide; subjecting the tobacco to conditions such that the moisture in the tobacco is converted into solid form; and, subjecting the solid impregnated tobacco to pressure and temperature conditions for a preselected pre-separator limited residence time of less than approximately 0.1 seconds whereby the solid is vaporized to cause expansion of the tobacco to yield an exit tobacco with a moisture content in the range of approximately 9% to approximately 15% oven volatiles and fill values at least equivalent to fill values of tobaccos dried to a lower moisture content not exceeding 6% oven volatiles.

It is to be understood that various changes can be made in the several steps of the inventive process disclosed herein by one skilled in the art without departing from the scope or spirit of the invention.

DETAILED DESCRIPTION OF THE PREFERRED EMBODIMENTS

In carrying out the inventive process set forth herein it is to be understood that anyone of several structural arrangements known in the art can be utilized, including certain of those arrangements disclosed in the patents and patent applications above noted for expanding impregnated tobaccos in duct systems and associated, communicating dryer chambers. Accordingly, in the interest of brevity, details of such structural arrangements are not disclosed herein, it being noted that the structural arrangement used in the conventional prior art process leading to a compilation of comparative data for hereinafter described TABLE 1 was similar to that disclosed in FIG. 4 of aforementioned U.S. Pat. No. 4,528,995 and that the structural arrangement used in carrying out the inventive process leading to compilation of data for hereinafter described TABLES 2, 3 and 4 was similar to that disclosed in FIG. 5 of the aforementioned pending patent application Ser. No. 541,752.

Generally, the tobacco to be treated by the inventive process is ordered with a mixture, for example, of water and glycerin to a level above conventional cutting moistures. In this regard, ordering tobacco to conventional cutting moistures produces tobacco with "O.V." or oven volatiles (as determined by the weight loss of a sample dried in a prewarmed forced draft oven at 110° C. for 3.25 hours) of approximately 20% by weight. In accordance with the present invention the ordering step is controlled to produce a tobacco which is higher than such conventional cutting moistures or an ordering to a range of approximately 22% moisture by weight to approximately 26% moisture by weight and advantageously to approximately 25% moisture by weight. The ordered tobacco in the inventive process is then cut to approximately 30 cuts per inch and placed in a high pressure vessel. Gaseous carbon dioxide at high pressure usually about 400 psig is introduced and this is followed with the introduction of liquid carbon dioxide under pressure. Subsequently, the pressure in the vessel is reduced to ambient to convert the moisture in the tobacco to a solid form. The tobacco with the above moisture is then treated in an ultra low residence time expander, as opposed to conventional higher residence time expanders, at preselected pressure and temperature conditions so that the result is an exit expanded tobacco with a moisture content in the range of approximately 9% to 15% oven volatiles by weight which is higher than the 1% to 6% oven volatiles range normally experienced and the amount of expansion is in excess of 60%. Furthermore, as can be seen from TABLES 2 through 4 below, this increased exit moisture results in particle size improvements since the particles are less brittle and friable and decreases in glycerin, alkaloid and total sugar losses since the tobacco temperature is lower with the combination of high moisture and comparatively ultra low expander residence time.

As illustrative of the improvements brought about in carrying out the several steps of the present invention, four Examples with an accompanying TABLE of data for each are set forth below, TABLE 1 of Example 1 setting forth data involving near conventional pre-separator residence times. In this regard, it is to be noted that the reduced residence time from 0.7 seconds of TABLE 1 to 0.06 seconds as reflected in the data of TABLES 2, 3, and 4 is accomplished in the given Examples mainly through reduced pre-separator residence time, the residence time in the separator being substantially the same for all of the Examples below. Ordinarily, the residence time in the separator itself is approximately 1.4 seconds. It further is to be noted that the Borgwaldt Fill Value test results in the TABLES below were obtained by compressing a defined weight of test tobacco in a cylinder under a 3 Kg (freefall) load for a duration of 30 seconds. Sample weight and height of the compressed tobacco column served to calculate filling power expressed in cc./gr. As to the particle size distribution (PSD) data reflected in the TABLES, this data was generally accomplished by placing a weighed quantity of tobacco on the top screen of a Ro-Tap device and sieving it through a series of successive Tyler screens of indicated preselected mesh size.

EXAMPLE 1

In this example, a tobacco blend of 50% flue-cured/50% burley tobaccos was conditioned and ordered to the moisture percentages indicated in Table 1 (A–F). The ordered tobacco was then cut at 30 cuts per inch and contacted, firstly with gaseous carbon dioxide then liquid carbon dioxide under pressures in the range of approximately 370 psig to approximately 425 psig and temperatures in the range of approximately 14° F. to approximately 23° F. The pressure was released, thereby changing the water within the tobacco to solid form. The frozen tobacco was then delumped and passed through a frozen surge bulker, a weigh conveyor and into an expander/tangential dryer separator. As disclosed in FIGS. 3 and 4 of U.S. Pat. No. 4,528,995, the feeding of the frozen tobacco into the dryer system was accomplished through a rotary airlock leading into a horizontal duct. The duct then turned 90°, rose vertically, turned 90° again, and connected to a tangetial separator. The residence time in the duct was approximately 0.7 seconds. The residence time in the separator was the conventional, approximately 1.4 seconds. The expanded tobacco was then conveyed to a reordering cylinder where the moisture was adjusted to approximately 12% by weight oven volatiles with a water spray at 50°–60° F. and cooling air at 70° F. As can be seen in the below data of TABLE 1 collected for Example 1, with the comparatively longer pre-separator residence time of 0.7 seconds, even elevated dryer inlet moistures of approximately 25% by weight, did not appreciably elevate the exit moisture from the dryer. In addition, little, if any, improvements in particle size distribution can be seen when comparing the runs A through F of TABLE 1 with the hereinbelow runs B and C of TABLE 2 and the B runs of TABLES 3 and 4, which included both a comparatively shorter residence time of 0.06 seconds and elevated dryer inlet moistures of approximately 25% by weight. Further, no notable improvements can be seen in runs D, E and F of TABLE 1 as there are when compared to runs B and C of TABLE 2 and the B runs of TABLES 3 and 4, with respect to reduction of the percentage of glycerin, alkaloid and sugar losses.

TABLE 1

| | A | B | C | D | E | F |
|---|---|---|---|---|---|---|
| Dryer Data: | | | | | | |
| Pre-separator residence time (sec.) | 0.7 | 0.7 | 0.7 | 0.7 | 0.7 | 0.7 |
| Inlet gas temp. (°F.) | 620 | 625 | 625 | 630 | 625 | 625 |
| Gas rate (lb./hr.) | 76M | 76M | 76M | 76M | 76M | 76M |
| Solids rate (dry lb./hr.) | 3260 | 3340 | 3050 | 3520 | 3520 | 3350 |
| Moisture (% by weight) | | | | | | |
| Inlet to process | 21.3 | 22.7 | 22.6 | 25.8 | 24.8 | 23.7 |
| Exit separator air lock | 1.8 | 1.6 | 2.1 | 2.3 | 3.0 | 1.2 |
| Borgwaldt Fill Value (cc/g @ 14% moisture) | | | | | | |
| Inlet to process | 4.09 | 3.85 | 3.26 | — | 3.87 | 4.36 |
| Exit reorder final product | 7.44 | 7.29 | 6.92 | — | 6.85 | 7.24 |
| Expansion (%) | 82 | 89 | 62 | — | 77 | 66 |
| Particle Size Distribution (Tyler) | | | | | | |
| Exit reorder final product | | | | | | |
| +9 mesh (%) | 46 | 42 | 45 | 45 | 52 | 47 |
| −14 mesh (%) | 23 | 24 | 23 | 24 | 19 | 21 |
| Glycerin: (lb. glyc./lb. dry tob.) | | | | | | |
| Inlet to process | 3.8 | 3.1 | — | 5.6 | 6.7 | 4.3 |
| Exit reorder final product | 2.4 | 2.2 | — | 4.0 | 3.8 | 3.3 |
| Loss (%) | 37.0 | 29.0 | — | 29.0 | 43.0 | 23.0 |
| Alkaloids (%) | | | | | | |
| Inlet process | 3.13 | 3.13 | 3.13 | — | — | — |
| Exit reorder final product | 1.93 | 1.93 | 1.93 | — | — | — |
| Loss (%) | 38.0 | 38.0 | 38.0 | — | — | — |

TABLE 1-continued

| | A | B | C | D | E | F |
|---|---|---|---|---|---|---|
| Total Sugars (%) | | | | | | |
| Inlet to process | 6.8 | 6.8 | 6.8 | — | — | — |
| Exit reorder final product | 5.5 | 5.5 | 5.5 | — | — | — |
| Loss (%) | 19.0 | 19.0 | 19.0 | — | — | — |

EXAMPLE 2

Tobacco was processed as in Example 1, except frozen tobacco was fed into the dryer duct immediately prior to the tangential separator. As a result, the pre-separator residence time was 0.06 seconds as compared to 0.7 seconds of Example 1, TABLE 1. It is to be understood that such shorter residence time advantageously can be in the range of approximately 0.01 to 0.1 seconds.

As can be seen in TABLE 2 below, runs 2A were ordered to an approximate moisture by weight of 20% oven volatiles while runs 2B and 2C were ordered to an approximate moisture by weight of 25% oven volatiles. Several inlet dryer gas temperatures were used for runs 2A, 2B and 2C. The increase in exit separator moisture for runs 2B and 2C compared to runs 2A should be noted. Further, the increase in Borgwaldt Fill Value percentages should be noted when comprising runs 2B and 2C with runs 2A. In addition, the improvements in particle size distribution should be noted when comparing runs 2B with runs 2A. Further, the reduction in glycerin losses should be noted when comparing runs 2B and 2C with the runs 1A through 1E of TABLE 1 and the reduction in alkaloid and sugar losses should be noted when comparing the runs of 2B and 2C with the runs of 2A. The decreases in the reordering spray requirements when comparing the runs of TABLE 2C and TABLE 2A should be noted, as should the decreases in tobacco temperatures when comparing the runs of TABLES 2B and 2C with the runs of TABLE 2A.

TABLE 2

| | A | | | B | | | C | | |
|---|---|---|---|---|---|---|---|---|---|
| Dryer Data: | | | | | | | | | |
| Pre-separator residence time (sec.) | 0.06 | 0.06 | 0.06 | 0.06 | 0.06 | 0.06 | 0.06 | 0.06 | 0.06 |
| Inlet gas temp. (°F.) | 508 | 566 | 624 | 508 | 562 | 625 | 515 | 582 | 647 |
| Gas rate (lb./hr.) | 76M | 76M | 76M | 76M | 76M | 76M | 76M | 76M | 76M |
| Solids rate (dry lb./hr.) | 3080 | 3080 | 3080 | 2900 | 2900 | 2900 | 3700 | 3700 | 3700 |
| Reordering Data: | | | | | | | | | |
| Total water sprayed (GPH) | 22 | 34 | 41 | — | — | — | 6 | 23 | 36 |
| Unit water sprayed (lb./water/1000 lb. tob.) | 60 | 92 | 111 | — | — | — | 14 | 52 | 81 |
| Tobacco Temp. (°F.) | | | | | | | | | |
| Exit separator air lock | 175 | 190 | 195 | 155 | 165 | 175 | 160 | 170 | 172 |
| Moisture (% by weight) | | | | | | | | | |
| Inlet to process | 20.3 | 20.2 | 20.2 | 24.7 | 24.7 | 24.7 | 24.8 | 24.8 | 24.8 |
| Exit separator air lock | 9.3 | 7.1 | 3.5 | 10.1 | 8.7 | 6.3 | 14.5 | 10.2 | 7.2 |
| Borgwaldt Fill Value (cc/g. @ 14% Moist) | | | | | | | | | |
| Inlet to process | 4.61 | 4.61 | 4.61 | 4.52 | 4.52 | 4.52 | 4.50 | 4.50 | 4.50 |
| Exit reorder final product | 7.80 | 8.05 | 8.15 | 7.75 | 8.05 | 8.25 | 7.44 | 8.05 | 8.39 |
| % Expansion | 69.0 | 75.0 | 77.0 | 71.0 | 78.0 | 83.0 | 65.0 | 79.0 | 86.0 |
| Particle Size Distribution (Tyler) Exit reorder final product | | | | | | | | | |
| +9 mesh (%) | 43 | 41 | 37 | 49 | 50 | 52 | — | — | — |
| −14 mesh (%) | 25 | 23 | 26 | 20 | 18 | 17 | — | — | — |
| Glycerin: (lb. glycerin/lb. dry tobacco) | | | | | | | | | |
| Inlet to process | — | — | — | 2.87 | 2.87 | 2.87 | 3.17 | 3.17 | 3.17 |
| Exit reorder final product | — | — | — | 2.93 | 2.78 | 2.61 | 3.06 | 2.97 | 2.83 |
| % Loss | — | — | — | 0 | 3.0 | 8.0 | 3.0 | 6.0 | 11.0 |
| Alkaloids (%) | | | | | | | | | |
| Inlet to process | 2.91 | 2.91 | 2.91 | 2.95 | 2.95 | 2.95 | 2.97 | 2.97 | 2.97 |
| Exit reorder final product | 2.46 | 2.42 | 2.24 | 2.68 | 2.56 | 2.33 | 2.76 | 2.69 | 2.47 |
| % Loss | 15.0 | 17.0 | 23.0 | 9.0 | 13.0 | 21.0 | 7.0 | 9.0 | 17.0 |
| Total Sugars (%) | | | | | | | | | |
| Inlet to process | 7.7 | 7.7 | 7.7 | 7.9 | 7.9 | 7.9 | 7.3 | 7.3 | 7.3 |
| Exit reorder final product | 7.5 | 6.6 | 6.7 | 7.8 | 7.5 | 7.5 | 7.2 | 7.2 | 6.6 |
| % Loss | 3.0 | 14.0 | 13.0 | 0 | 4.0 | 4.0 | 1.0 | 1.0 | 10.0 |

EXAMPLE 3

Tobacco was processed as in Example 2. As can be seen in Table 3 below, runs 3A were ordered to an approximate moisture by weight of 21.5% oven volatiles while runs 3B were ordered to an approximate moisture by weight of 25%. As in Example 2, the increase in exit separator moisture and decrease in exit separator temperature for runs 3B compared to runs 3A should be noted, as should the requirement for less water to reorder. Further, the increase in Borgwaldt Fill Value percentages should be noted when comparing runs 3B with runs 3A. In addition, the reduction in glycerin losses, alkaloid losses and total sugar losses should be noted when comparing runs 3B with runs 3A.

TABLE 3

| | A | | B | |
|---|---|---|---|---|
| Dryer Data: | | | | |
| Pre-separator residence time (sec.) | 0.06 | 0.06 | 0.06 | 0.06 |
| Inlet gas temp (°F.) | 612.0 | 631.0 | 570.0 | 584.0 |
| Gas rate (lb./hr.) | 76M | 76M | 76M | 76M |
| Solids rate (dry lb./hr.) | 4060 | 4060 | 4220 | 3960 |
| Reordering Data: | | | | |
| Total water sprayed (GPH) | 52 | 55 | 33 | 31 |
| Unit water sprayed (lb. water/1000 lb. tobacco) | 107 | 113 | 65 | 65 |
| Tobacco Temp. (°F.) | | | | |
| Exit separator air lock | 180 | 175 | 160 | 168 |
| Moisture (% by weight) | | | | |
| Inlet to process | 21.6 | 21.6 | 24.9 | 24.9 |
| Exit separator air lock | 5.9 | 4.5 | 9.3 | 9.1 |
| Borgwaldt Fill Value (cc/g. @ 14% Moist.) | | | | |
| Inlet to process | 4.82 | 4.82 | 4.27 | 4.27 |
| Exit reorder final product | 7.72 | 7.94 | 6.96 | 7.11 |
| % Expansion | 60.0 | 65.0 | 63.0 | 67.0 |
| Glycerin: (lb. glycerin/lb. dry tobacco) | | | | |
| Inlet to process | 2.38 | 2.38 | 3.35 | 3.35 |
| Exit reorder final product | 2.09 | 2.07 | 3.11 | 3.13 |
| % Loss | 12.0 | 13.0 | 7.0 | 7.0 |
| Alkaloids (%) | | | | |
| Inlet to process | 2.93 | 2.93 | 2.87 | 2.87 |
| Exit reorder final product | 2.47 | 2.42 | 2.72 | 2.69 |
| % Loss | 16.0 | 17.0 | 5.0 | 6.0 |
| Total Sugars (%) | | | | |
| Inlet to process | 8.7 | 8.7 | 8.5 | 8.5 |
| Exit reorder final product | 9.2 | 8.4 | 9.1 | 9.4 |
| % Loss | 0 | 3.0 | 0 | 0 |

EXAMPLE 4

Tobacco was processed as in Examples 2 and 3. As can be seen in TABLE 4 below, runs 4A were ordered to an approximate moisture by weight of 22% oven volatiles while runs 4B were ordered to an approximate moisture by weight of 24.5% oven volatiles. In comparing the runs of 4B with those of 4A, the improvements in particle size and expansion and the reduction of glycerin, alkaloid, and total sugar losses should be noted, as should the decrease in exit separator air lock temperatures and reordering spray amounts required.

TABLE 4

| | A | | B | |
|---|---|---|---|---|
| Dryer Data: | | | | |
| Pre-separator residence time (sec.) | 0.06 | 0.06 | 0.06 | 0.06 |
| Inlet gas temp (°F.) | 610.0 | 631.0 | 550.0 | 580.0 |
| Gas rate (lb./hr.) | 76M | 76M | 76M | 76M |
| Solids rate (dry lb./hr.) | 3900 | 3900 | 4000 | 4000 |
| Reordering Data: | | | | |
| Total water sprayed | 50 | 53 | 13 | 22 |
| Unit water sprayed (lb. water/1000 lb. tobacco) | 107 | 113 | 27 | 46 |
| Tobacco Temp. (°F.) | | | | |
| Exit separator air lock | 175 | 175 | 150 | 160 |
| Moisture (% by weight) | | | | |
| Inlet to process | 21.8 | 21.8 | 24.5 | 24.5 |
| Exit separator air lock | 6.7 | 5.6 | 11.5 | 10.4 |
| Borgwaldt Fill Value (cc/g @ 14% moisture) | | | | |
| Inlet to process | 4.91 | 4.91 | 4.42 | 4.42 |
| Exit reorder final product | 8.34 | 8.51 | 7.68 | 8.06 |
| % Expansion | 70.0 | 74.0 | 74.0 | 82.0 |
| Particle Size Distribution (Tyler) | | | | |
| Exit reorder final product | | | | |
| +9 mesh (%) | 38 | — | 43 | 44 |
| −14 mesh (%) | 28 | — | 22 | 23 |
| Glycerin: (lb. glycerin/lb. dry tobacco) | | | | |
| Inlet to process | 2.36 | 2.36 | 2.06 | 2.06 |
| Exit reorder final product | 2.19 | 2.19 | 1.99 | 1.93 |
| % Loss | 7.0 | 7.0 | 3.0 | 6.0 |
| Alkaloids (%) | | | | |
| Inlet to process | 3.05 | 3.05 | 3.01 | 3.01 |
| Exit reorder final product | 2.56 | 2.48 | 2.81 | 2.69 |
| % Loss | 16.0 | 19.0 | 7.0 | 11.0 |
| Total Sugars (%) | | | | |
| Inlet to process | 9.5 | 9.5 | 9.4 | 9.4 |

TABLE 4-continued

| | A | | B | |
|---|---|---|---|---|
| Exit reorder final product | 8.5 | 8.5 | 8.8 | 9.1 |
| % Loss | 11.0 | 11.0 | 6.0 | 3.0 |

Thus, from the above Examples and their respective data TABLES, it being noted that all expanded products were reordered to a final moisture of 12% O.V., it readily can be seen that the inventive process provides a tobacco treating process with improved control of glycerin, alkaloid and total sugar losses, improved particle size control and improved tobacco fill value and, at the same time, requiring less water spraying and cooling for reordering and storage of the tobacco.

We claim:

1. An improved tobacco treating process comprising ordering tobacco to a preselected moisture content sufficient to yield an exit tobacco moisture in the range of approximately 9% to approximately 15% oven volatiles and fill values at least equivalent to fill values of tobaccos dried to a moisture content not exceeding 6% oven volatiles; contacting the ordered tobacco, under pressure, with gaseous carbon dioxide; contacting the ordered tobacco, under pressure, with liquid carbon dioxide after said contacting with gaseous carbon dioxide; subjecting the tobacco to conditions such that the moisture in the tobacco is converted to solid form; and subjecting the tobacco to pressure and temperature conditions for a preselected pre-separator limited residence time of less than 0.1 seconds to yield an expanded tobacco product with a moisture content in the range of approximately 9% to approximately 15% oven volatiles by weight and fill values at least equivalent to fill values of tobaccos dried to a lower moisture content not exceeding 6% oven volatiles at a pre-separator greater than 0.1 seconds.

2. The process of claim 1, wherein said ordering is accomplished with a mixture of glycerin and water.

3. The process of claim 1, wherein said tobacco is ordered to have a moisture content of approximately 25% by weight.

4. The process of claim 1, said tobacco comprising a blend of 50% flue-cured and 50% burley tobaccos by weight.

5. The process of claim 1, said contacting with carbon dioxide is accomplished at a pressure in the range of approximately 370 psig to approximately 425 psig and temperature in the range of approximately 14° F. to approximately 23° F.

6. The process of claim 1, said exit tobacco having a moisture content of approximately 11% oven volatiles.

7. The process of claim 1, wherein the solidified impregnated tobacco is subjected to pre-separator and separator vaporization with the pre-separator residence time being in the range of approximately 0.01 to 0.1 seconds.

8. The process of claim 1, wherein the solidified impregnated tobacco is subjected to pre-separator and separator vaporization with the pre-separator residence time being approximately 0.06 seconds and the separator residence time being approximately 1.4 seconds.

9. The process of claim 1, wherein said ordered tobacco is cut to approximately 30 cuts per inch.

10. The process of claim 1, wherein said expanded tobacco is reordered when necessary to a moisture content of at least approximately 12% oven volatiles by weight.

11. The process of claim 1, wherein said tobacco has an inlet moisture content of approximately 22% by weight to approximately 26% by weight prior to contacting with carbon dioxide.

12. An improved tobacco treating process comprising ordering tobacco with a mixture of glycerin and water wherein said tobacco has a moisture content of approximately 25% by weight; contacting the ordered tobacco with gaseous carbon dioxide at pressure in the range of approximately 370 psig to approximately 425 psig and temperature in the range of approximately 14° F. to approximately 23° F.; contacting the ordered tobacco with liquid carbon dioxide; and reducing the pressure sufficiently to freeze the moisture in the tobacco; and, subjecting the tobacco to pre-separator and separator vaporization with the pre-separator residence time being approximately in the range of 0.01 to 0.1 seconds to provide an exit tobacco having a moisture content of approximately 11% oven volatiles and fill values at least equivalent to fill values of tobaccos dried to a lower moisture content not exceeding 6% at a pre-separator residence time greater than 0.1 seconds.

13. An improved tobacco treating process comprising ordering tobacco to a preselected moisture content sufficient to yield an exit tobacco moisture in the range of approximately 9% to approximately 15% oven volatiles and fill values at least equivalent to fill values of tobaccos dried to a lower moisture content not exceeding 6%; contacting the ordered tobacco with gaseous carbon dioxide then liquid carbon dioxide under pressure and temperature and subsequently reducing the pressure sufficiently to form a solid within the tobacco; and subjecting the tobacco to pressure and temperatures conditions for a preselected limited residence time of less than approximately 0.1 seconds to yield an expanded tobacco product with a moisture content in the range of approximately 9% to 15% oven volatiles and fill values at least equivalent to fill values of tobaccos dried to a lower moisture content not exceeding 6% at a pre-separator residence time greater than 0.1 seconds.

* * * * *